US011745981B2

(12) United States Patent
Sotoca et al.

(10) Patent No.: US 11,745,981 B2
(45) Date of Patent: Sep. 5, 2023

(54) MOUNTING APPARATUS FOR SAFETY BRAKE

(71) Applicant: Otis Elevator Company, Farmington, CT (US)

(72) Inventors: Javier Muñoz Sotoca, Madrid (ES); Tanjil Mustafa, New Britain, CT (US); James M. Draper, Woodstock, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 506 days.

(21) Appl. No.: 16/867,806

(22) Filed: May 6, 2020

(65) Prior Publication Data

US 2020/0354192 A1 Nov. 12, 2020

(30) Foreign Application Priority Data

May 8, 2019 (EP) ..... 19382352

(51) Int. Cl.
*B66B 5/18* (2006.01)
*B66B 5/16* (2006.01)

(52) U.S. Cl.
CPC . *B66B 5/18* (2013.01); *B66B 5/16* (2013.01)

(58) Field of Classification Search
CPC ..... B66B 5/16; B66B 5/18; B66B 5/22
See application file for complete search history.

(56) References Cited

U.S. PATENT DOCUMENTS 4,538,706 A * 9/1985 Koppensteiner ..... B66B 5/22 188/41
5,002,158 A * 3/1991 Ericson ..... B66B 5/22 187/314
5,096,020 A 3/1992 Korhonen
8,312,972 B2 * 11/2012 Gremaud ..... B66B 5/22 187/371
9,821,983 B2 * 11/2017 Billard ..... B66B 5/22
(Continued)

FOREIGN PATENT DOCUMENTS

EP 3677534 A1 * 7/2020 ..... B66B 1/3423
GB 2314070 A * 12/1997 ..... B66B 5/18
(Continued)

OTHER PUBLICATIONS

European Search Report for application EP 19382352.3, dated Nov. 28, 2019, 6 pages.

*Primary Examiner* — Minh Truong
(74) *Attorney, Agent, or Firm* — CANTOR COLBURN LLP

(57) ABSTRACT

An elevator car or counterweight, comprising a frame, the frame including an upright structure in which a safety brake is mounted so as to allow for lateral movement of the safety brake relative to the upright structure; at least a first vertically or obliquely extending cantilever spring; wherein a first end of the first cantilever spring is mounted to the upright structure; and wherein the first cantilever spring is arranged such that a point remote from the first end provides a biasing force to the safety brake when the safety brake moves away from a default position. As the safety brake is mounted to allow for lateral movement relative to the frame, the safety brake essentially floats relative to the car or counterweight.

11 Claims, 4 Drawing Sheets

(56) References Cited

U.S. PATENT DOCUMENTS

| | | | | |
|---|---|---|---|---|
| 10,640,331 | B2 * | 5/2020 | Kakio | B66B 5/22 |
| 2018/0222717 | A1 | 8/2018 | Billard et al. | |
| 2022/0177272 | A1 * | 6/2022 | Blochle | B66B 5/22 |

FOREIGN PATENT DOCUMENTS

| | | | | |
|---|---|---|---|---|
| KR | 200326832 | Y1 * | 9/2003 | B66B 5/22 |
| KR | 20030093946 | A | 12/2003 | |
| WO | 2018185127 | A1 | 10/2018 | |

* cited by examiner

MOUNTING APPARATUS FOR SAFETY BRAKE

FOREIGN PRIORITY

This application claims priority to European Patent Application No. 19382352.3, filed May 8, 2019, and all the benefits accruing therefrom under 35 U.S.C. § 119, the contents of which in its entirety are herein incorporated by reference.

TECHNICAL FIELD

The present disclosure relates to mounting apparatus for elevator safety brakes, in particular to mounting apparatus for safety brakes that can accommodate movement of the elevator car.

BACKGROUND

Elevator safety brakes are normally mounted on the frame of an elevator car or counterweight and engage with a rail mounted to a wall of the hoistway so as to provide friction and stop the car or counterweight. During an emergency stop, when the safety brake is actuated it will not always be perfectly centred on the guide rail, for example due to imbalances in the loading of the car or of the drive system.

As the car or counterweight moves up and down the hoistway it is guided on the rails by guidance systems such as rollers or sliders. In order to provide a smooth and comfortable ride experience to passengers and to reduce operational noise, these guidance systems accommodate some movements of the elevator car or counterweight. However, such movements may result in the safety brake not being perfectly centred on the rail when it is required.

Traditionally, safety brakes have been firmly mounted to the elevator car or counterweight frame. Thus if the brake is off centre when it engages, there will be an imbalance (and possibly reduction) in the force provided. For example, in safeties where two wedges are provided, one on either side of the guide rail, when the safety engages in an off-centre situation, only one wedge (and brake pad) will initially contact the guide rail. In order to bring the other wedge (and brake pad) into engagement with the other side of the guide rail, the safety has to move itself (and thus the whole elevator car or counterweight to which it is attached). For asymmetric safeties, this dynamic behaviour will also occur even if the safety wedges are perfectly centred with respect to the guide rail. This is due to asymmetric safeties having only one wedge (driving wedge) that gets pulled up during a safety event. The driving wedge forces the entire safety to translate laterally to bring the stationary wedge into contact with the rail. This results in the entire car moving laterally. This puts extra strain on the safety and may increase the time to full engagement. Moreover, such movement may be to some extent resisted by the stiffness in the guidance mechanisms (e.g. the rollers or sliders which guide the car or counterweight). Such resistance may again cause an imbalance in the safety engagement which may reduce its operational effectiveness. Furthermore, roller guide design requirements are limited by safety performance.

SUMMARY

According to a first aspect of the present disclosure there is provided an elevator car or counterweight, comprising a frame, the frame comprising an upright structure in which a safety brake is mounted so as to allow for lateral movement of the safety brake relative to the upright structure; at least a first vertically or obliquely extending cantilever spring; wherein a first end of the first cantilever spring is mounted to the upright structure; and wherein the first cantilever spring is arranged such that a point remote from the first end provides a biasing force to the safety brake when the safety brake moves away from a default position.

According to a second aspect of the present disclosure there is provided a method of mounting a safety brake to an upright structure of a frame of an elevator car or counterweight so as to allow lateral movement of the safety brake relative to the upright structure; the method comprising: mounting a first end of at least a first vertically or obliquely extending cantilever spring to the upright structure such that a point remote from the first end provides a biasing force to the safety brake when the safety brake moves away from a default position.

As the safety brake is mounted to allow for lateral movement relative to the frame, the safety brake essentially floats relative to the car or counterweight. Thus, in operation, if there is an imbalance in the car and/or if the safety brake is otherwise not optimally aligned with the rail against which it brakes, the safety brake itself can move so as to attain an optimal braking position rather than having to move the whole mass of the car or counterweight. Further, in prior systems in which the whole car or counterweight had to move, such movement causes compression of the guidance mechanism (e.g. the guide rollers or sliders) which creates resistance to the movement. The amount of resistance depends on the stiffness of the guidance mechanism which can vary from one installation to another and this resistance can be enough to prevent full engagement of the safety brake, thus reducing the braking force that can be applied.

When the safety brake is arranged for lateral movement relative to the frame, it can move so as to compensate for any misalignments at the time of braking and can thus apply its optimal braking force regardless of the asymmetry of the elevator car or counterweight. In this way, the safety brake is decoupled from the car or counterweight and also from the guidance mechanisms thereof.

After the safety brake has been operated and it is desired to return the system to normal use, it is necessary to return the safety brake to its default position, i.e. to a position in which it is not engaged with the rail and does not hinder elevator car or counterweight movement and does not suffer wear through contact with the rail.

The use of one or more cantilever springs to provide a biasing force to return the safety brake to the default position is particularly advantageous as the cantilever arrangement takes up very little lateral width. In smaller elevator systems, the available width in the frame upright is very limited. A floating safety brake (i.e. one which is mounted so as to permit lateral movement relative to the upright) already takes up a greater lateral width than a traditional safety that is rigidly fixed to the upright and therefore there is limited space in which to incorporate a mechanism by which to return it to its default position. The cantilever spring has the benefit that it is long in the vertical direction and narrow in the lateral (horizontal) direction. Furthermore, its length means that the mount point (at the first end of the spring) can be located either vertically above or below the safety brake where it is not constrained by the presence of (or the mount points for) the safety brake itself. Vertical space is more readily available and therefore the cantilever spring allows to make use of this space while minimising the lateral impact of the mounting arrangement.

The cantilever spring may extend either vertically or obliquely, i.e. at an angle to the vertical. Thus the cantilever spring extends at least partially in the vertical direction, preferably substantially in the vertical direction. The cantilever spring preferably extends at an angle of no more than 30 degrees to the vertical, more preferably no more than 20 degrees to the vertical and yet more preferably no more than 10 degrees to the vertical. A certain amount of obliqueness (i.e. angle to the vertical) can be tolerated within the space that is normally available and indeed a small angle to the vertical may be convenient in certain circumstances (e.g. for a particular mounting arrangement), but it is generally preferred to keep the cantilever spring is as close as possible to vertical.

In use, when the safety brake engages and consequently moves away from its default position to effect braking, it will push against the cantilever spring, bending the spring away from its neutral position such that the spring provides a biasing force to return the brake back to its default position. The force provided by the cantilever spring can be selected so that it does not reduce the effectiveness of the safety brake. That is, the strength of the spring can be selected such that it will provide enough force to reliably return the safety brake to its default position when the brake is released, but will readily deflect under braking conditions. The force required to deflect the spring is preferably much less than would be required to move the whole elevator car or counterweight and is preferably also much less than would be required to compress the guidance mechanism to accommodate the required brake movement. For example, the force required to deflect the cantilever spring may be an order of magnitude less than that required to deflect the guide rollers. Purely by way of example, in one particular arrangement, the force required to reset a safety brake was found to be 70 N at a deflection of 3 mm, while in the same arrangement the roller guides were found to provide a force of 500 N at a deflection of only 1 mm (and would provide much more at 3 mm). It should also be noted that it is much easier to adjust the reset force of the cantilever spring by appropriate design of the spring than it is to adjust the reaction force of the roller guides.

The cantilever spring can be arranged such that it provides a biasing force only in one direction. To achieve this, it only needs to make contact with the safety brake on one side thereof, or indeed on one side of one projection thereof and thus takes up minimal, if any, space to the lateral side of the brake. It should be noted that space around the safety brake is generally also limited in the space between the elevator car or counterweight and the hoistway wall, and so mounting the spring to engage with a projection that sticks out in that direction should also be avoided or minimised where possible.

A single cantilever spring arranged to contact the safety brake on one lateral side can only provide a return force in one direction and thus does not accommodate bidirectional movement of the safety brake. In some arrangements this may be sufficient, i.e. the safety brake may be expected only to translate laterally in one direction as it may be arranged so that the elevator car or counterweight will never be offset in the other direction. However, in most cases the elevator car or counterweight is mounted as centrally and stably as possible, which means that the safety brake may be offset from its ideal position in either lateral direction and thus should ideally be able to accommodate movement in either direction. Accordingly, the first cantilever spring is preferably arranged to provide a biasing force to the safety brake when the safety brake moves away from the default position in either lateral direction.

In order to achieve such bidirectional biasing, a second end of the first cantilever spring may be mounted to the safety brake rigidly in the lateral direction rather than simply contacting it on one side. Thus the second end of the spring may be mounted such that it cannot move laterally relative to the safety brake. This can be achieved for example by constraining the second end of the spring in a slot of the safety brake or between two vertically extending projections that sandwich the second end of the spring between them. Alternatively, a mounting hole in the second end of the spring may be fitted over a projection on the safety brake such that movement of the projection in either end, pulls the second end of the spring in the same direction. Whatever attachment mechanism is used, it secures the second end of the spring to the safety brake in the lateral direction (i.e. the direction in which the safety brake floats) such that displacement of the safety brake in either direction causes the spring to deform and thus bias the safety brake back towards its default position. The second end of the spring thus has no freedom to move laterally with respect to safety brake.

The elevator car or counterweight may further comprise a second vertically extending cantilever spring; wherein a first end of the second cantilever spring is mounted to the upright structure; and wherein the second cantilever spring is arranged such that a point remote from the first end provides a biasing force to the safety brake when the safety brake moves away from a default position; and wherein the biasing force provided by the first cantilever spring is in the opposite direction to the force provided by the second cantilever spring. Such an arrangement also provides a bidirectional return-to-centre (or return-to-default) mechanism, but using two springs instead of one (more springs could of course be used if desired, e.g. for redundancy). Although each spring could be mounted or fixed to the safety in some way, with a two spring arrangement each spring only needs to make contact with the safety brake (one on each side) in order to provide the bidirectional utility. This makes for simple manufacture and installation and means that no additional mount points or structures are required on the safety brake, thus minimising or avoiding the need to redesign existing components. As both the first and second springs are cantilevered, they both take up very little (if any) space in the lateral direction and thus are ideally suited for installation in a narrow upright structure in small elevator systems.

In certain preferred examples, a second end of the or each cantilever spring may be mounted to the safety brake with freedom to move vertically relative to the safety brake. By mounting the spring(s) to the safety brake in this manner, the braking forces that are applied through the safety brake in use (being vertical forces) will not be transmitted (at least to any significant degree) through the springs as any relative movement of the safety brake relative to the spring's mount point at its first end can be accommodated by the freedom of movement at the spring's second end. This ensures that damage to the springs is minimised or avoided, thus increasing product lifetime and reducing maintenance costs. It will be appreciated that in other arrangements the first end of the or each cantilever spring may be mounted to the upright structure with freedom to move vertically relative to the upright structure. This achieves the same effect as described above.

The upright structure may be substantially U-shaped, such that it comprises a web and two flanges (alternatively referred to as a base and two sides). This may be to provide structural rigidity to the frame and/or to accommodate other structures on the elevator car or counterweight. The flanges may be parallel to each other and may be perpendicular to the web, but other shapes are also possible. For example, the flanges may extend substantially perpendicularly to the web, or may be angled thereto. The U-shape may be a simple U-shape open towards the hoistway or it may be one side of an I-beam construction (or other beam construction), again with these structures being mounted in the side that is open towards the hoistway.

The first end of the or each spring may be mounted to the web of the U-shaped upright structure. This may be preferred in single spring arrangements where the second end of the spring is preferably mounted to the safety brake at a laterally intermediate point of the safety brake rather than contacting either one of its sides. As discussed earlier, the cantilever springs allow such mounting to be located vertically above or below the main safety brake structure where such mounting to the web of the U-shaped upright structure does not interfere with the mounting of the safety brake itself. For example, as the mounting is not laterally in line with the safety brake it does not increase the overall required width for the safety brake and as the mounting is not underneath (i.e. between the safety brake and the web of the U-shaped upright structure) it does not increase the overall depth of the safety brake arrangement.

In other examples in which the upright structure is substantially U-shaped, such that it comprises a web and two (optionally parallel) flanges, the first end of the first cantilever spring may be mounted to one flange of the U-shaped upright structure; and the first end of the second cantilever spring may be mounted to the other flange of the U-shaped upright structure. Such mounting to the flanges of the U-shaped structure may interfere less with other structures, and may make for easier installation. In particular, due to the cantilever nature of the springs, the length of the spring can be selected so that the mount point of the first end is in a convenient place for installation. As this mount point can be located vertically away from the safety brake, it does not add to the lateral space requirements of the safety brake and yet can still be easily accessed for installation or maintenance.

The first end of the first and/or second cantilever spring may be mounted to its respective flange of the U-shaped upright structure via an intermediate spacer that positions the second end of the respective cantilever spring in unbiased contact with the safety brake when the safety brake is in its default position. As the safety brake is mounted to allow for some lateral movement, the side faces thereof are laterally spaced from the flanges of the U-shaped upright structure (so that they can move towards those flanges when required during operation). The use of intermediate spacers to mount the first ends of the springs allows straight cantilever springs to be used, i.e. springs that extend substantially straight from the first end to the second end. Such springs are particularly easy and inexpensive to manufacture as they can simply be cut from a longer length of material without any need for further shaping steps. The intermediate spacer(s) may be sized so as to space the first end of the spring(s) directly below (vertically below) the respective side of the safety brake with which it is to make contact. Thus, contact will be made between the safety brake and the spring while the safety brake is in its default position and the spring is in its neutral, unbiased shape. Thus, in normal (non-braking) operation the two components are minimally stressed which helps to prolong component life. Accordingly, in some examples, it is preferred that the first and/or second cantilever spring be substantially straight.

In other examples, the second end of the first and/or second cantilever spring may be shaped so as to position a biasing surface of the respective spring in unbiased contact with the safety brake when the safety brake is in its default position. Such arrangements require some shaping of the spring elements, but avoid the need to provide intermediate spacers. Thus the first end of the (or each) spring can be mounted directly to the flange of the U-shaped upright structure, reducing the number of components required for installation. In some particularly preferred examples, the second end of the first and/or second cantilever spring may be curved so as to make a tangential contact with the safety brake. Such an arrangement accommodates some rotation of the safety brake with respect to the spring(s).

In some examples the or each cantilever spring may be arranged to exert its biasing force on the safety brake through a centre of mass of the safety brake. In the absence of other forces, this ensures that the force of the spring does not introduce any rotation of the safety brake, and thus returns it to its default position efficiently. However, it has been found that in some cases, the application of spring force through the centre of gravity does introduce a rotation in the safety brake. This may be due to friction at the mount points which mount the safety brake to the upright structure. Therefore, in some preferred examples the or each cantilever spring may be arranged to exert its biasing force on the safety brake at a point laterally in line with a mounting point of the safety brake to the upright structure. These are the mounting points that allow the safety brake to float, and thus there may be some friction at these points during the return-to-default movement. Accordingly, providing the biasing force of the spring in line with these points reduces the torque and ensures efficient and reliable return of the safety brake to its default position. Of course, depending on the particular arrangement, such arrangements may also be through, or close to through, the centre of gravity.

DETAILED DESCRIPTION

Certain examples of the present disclosure will now be described, by way of example only, with reference to the accompanying drawings in which.

Figure 3C:
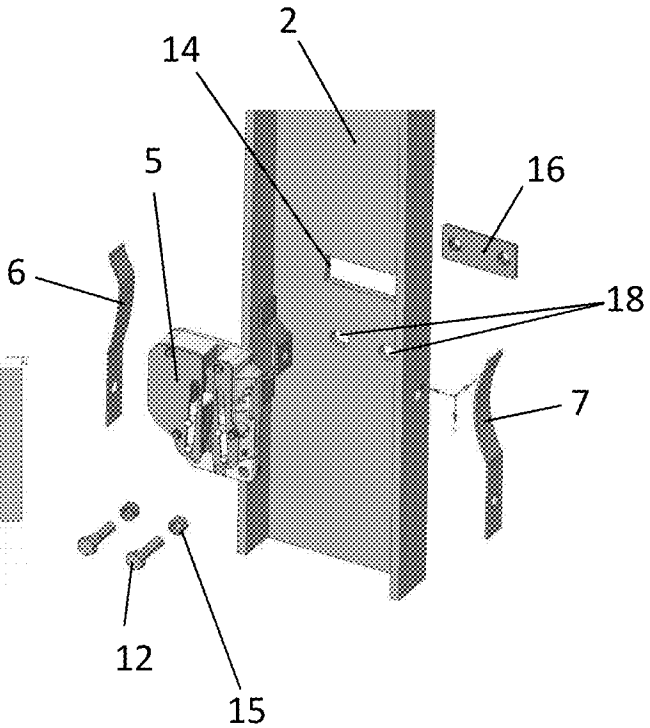
Figure 3B:
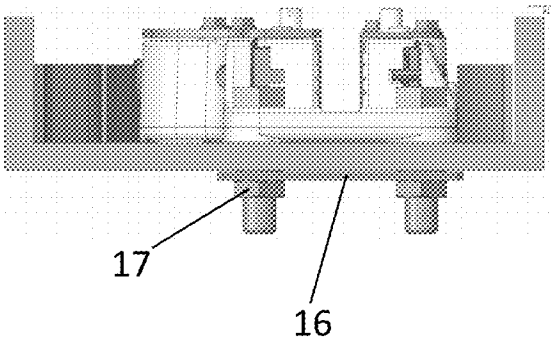
Figure 3A:
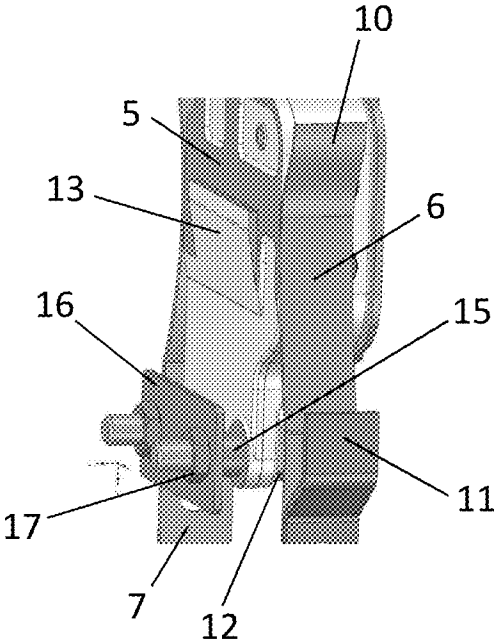

FIGS. 3*a-c* show further views of the first example; and

Figures 4A, 4B, 4C:
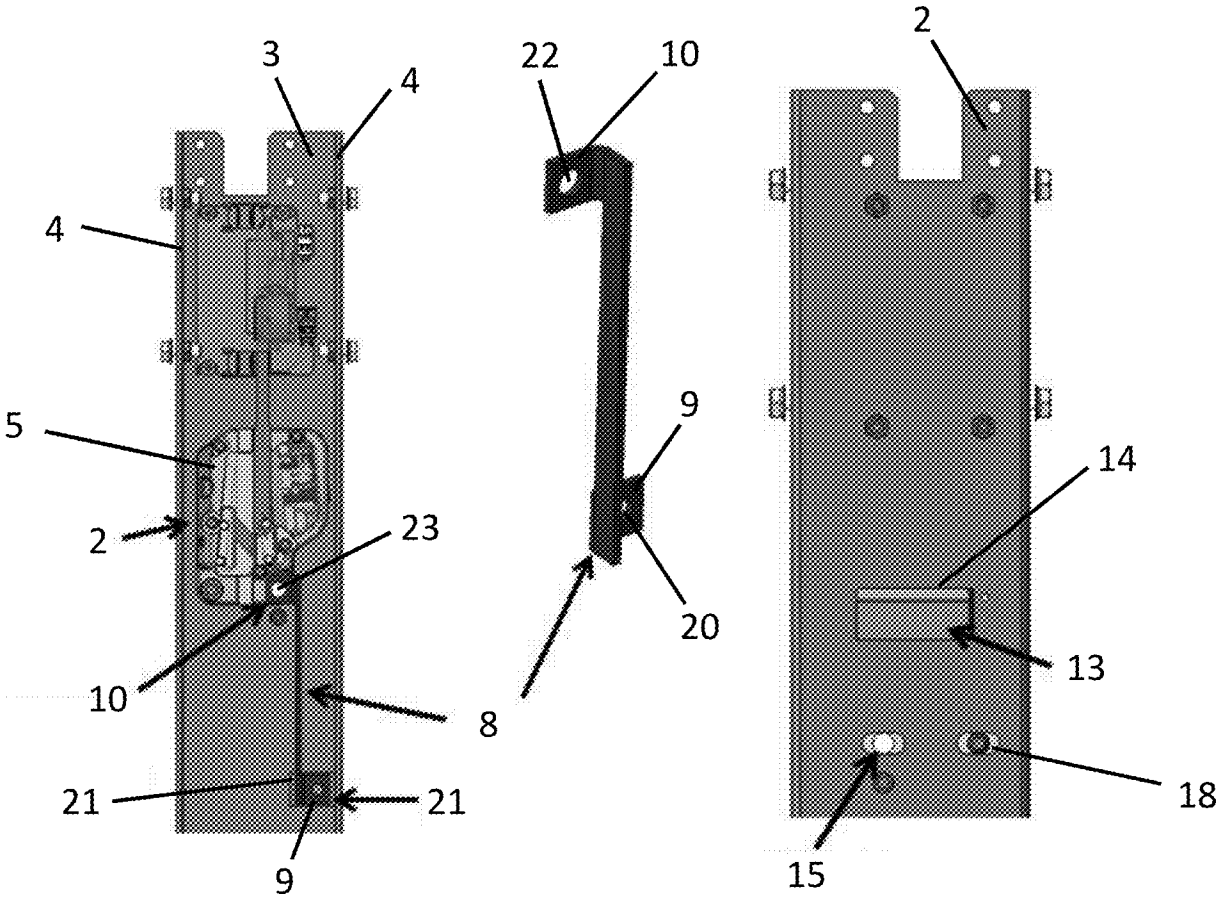

FIG. 4*a-c* shows a third example of a safety brake mounting arrangement.

Figure 1:
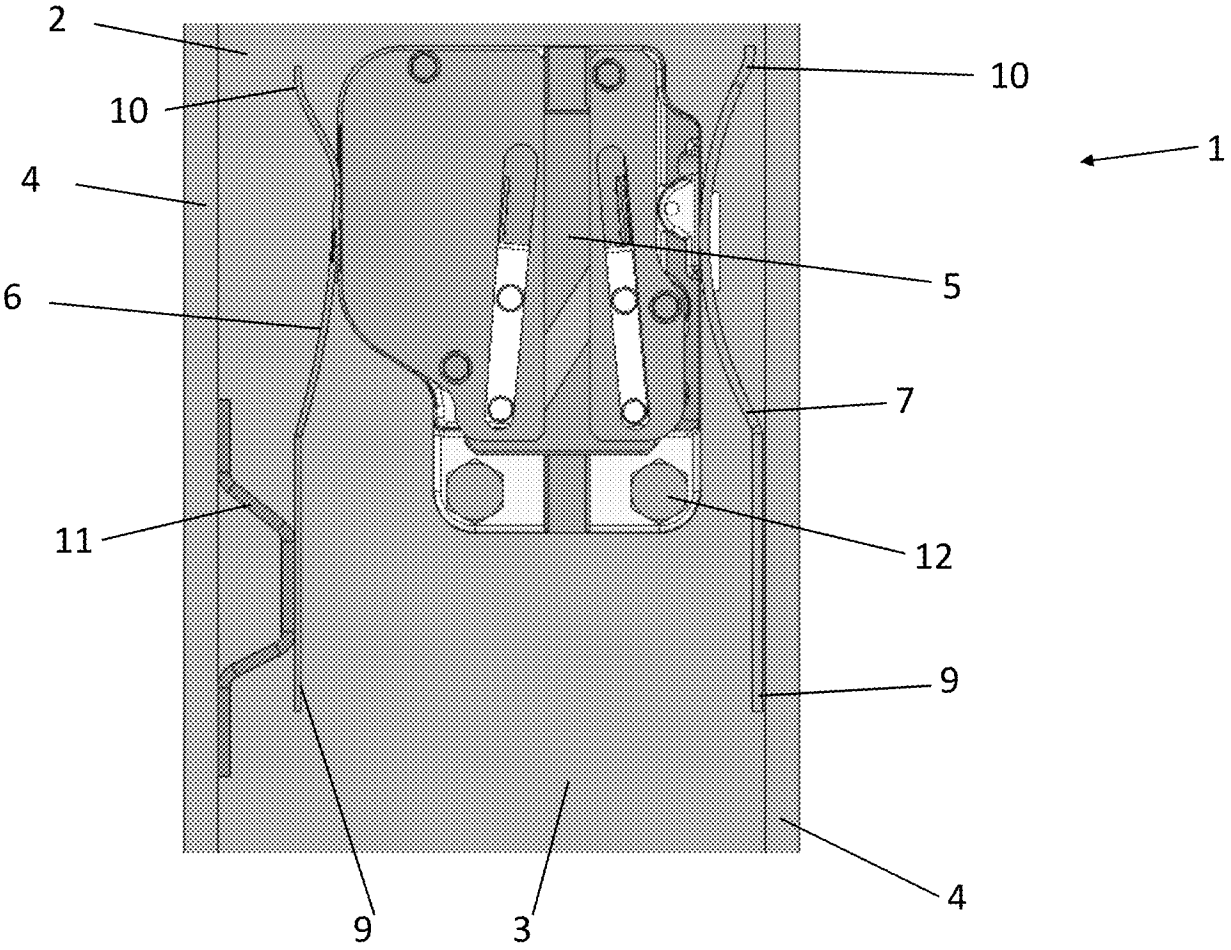
FIG. 1 shows a first example of a safety brake mounting arrangement.

FIG. 1 shows a floating safety brake arrangement 1 mounted to a vertical upright structure 2 of a frame of an elevator car (or equally of an elevator counterweight). The upright structure 2 has a square U-shaped profile comprising a web (or base) 3 and two flanges (or sides) 4 which extend away from the web 3 in the direction from the elevator car towards a hoistway wall.

A safety brake 5 is mounted to the web 3 of the upright structure 2 in a floating manner which can better be understood from FIGS. 3*a-c*. The safety brake 5 is mounted to the upright structure 2 such that it can move laterally (left and right in FIG. 1) with respect to the upright structure 2. This allows the safety brake 5 to move, when it is operated so as to brake, such that it is better aligned with the guide rail against which it brakes, while not requiring any corresponding movement of the upright structure 2 or indeed the car or counterweight to which it is attached. This allows the safety brake to "float" into the optimal position and allows it to provide full braking force against the guide rail without being hindered by either the mass of the car or counterweight or by the stiffness of the guidance mechanisms such as guide rollers that hold the car or counterweight to the guide rails with allowance for movement (so as to reduce noise and vibration for a more comfortable ride).

In order to return the safety brake 5 to its centre, i.e. its default position after it is released from a braking operation, a first cantilever spring 6 and a second cantilever spring 7 are provided. The first cantilever spring 6 contacts the safety brake on one side, while the second cantilever spring 7 contacts the safety brake on the other, opposite side. If a braking operation causes the safety brake to move to the left in FIG. 1, i.e. towards the first cantilever spring 6, then that movement will deflect the first cantilever spring 6 such that it will resist the movement and provides a biasing force back towards the default position. Similarly if a braking operation causes the safety brake to move to the right in FIG. 1, i.e. towards the second cantilever spring 7, then that movement will deflect the second cantilever spring 7 such that it will resist the movement and provides a biasing force back towards the default position. The biasing forces provided by these springs are relatively low, being sufficient to ensure reliable return of the safety brake to its default position, i.e. sufficient to overcome any expected frictional forces, but still providing much lower resistance to the safety brake 5 than it would experience if fixedly mounted to the upright structure 2 (i.e. the forces are lower than those required to move the whole car/counterweight, or to compress the guide members). Thus improved safety brake operation is achieved.

In FIG. 1, the first cantilever spring 6 and the second cantilever spring 7 are substantially elongate strips of metal, each having a first end 9 (lower end in the Figure) which is mounted to the upright structure 2 and a second end 10 (upper end in the Figure) which is shaped into a curve which curves in the direction from the first end 9 towards the second end 10 initially towards the safety brake 5 before making contact with the safety brake 5 and then curving away from the safety brake 5 such that a tangential contact is made with the safety brake 5. The second ends 10 of the cantilever springs 6, 7 are free, i.e. not mounted either to the upright structure 2 or the safety brake 5.

In FIG. 1, the first end 9 of the second cantilever spring 7 is mounted directly to the flange (or side wall) 4 of the upright structure 2 (e.g. screwed to the flange 4). This is convenient as the safety brake 5 in this example is closer to the right hand flange 4 than the left hand flange 4. On the other hand, the first cantilever spring 6 is mounted indirectly to the flange 4 via an intermediate spacer 11. The spacer 11 reduces the amount of shaping required at the second end 10 of the first cantilever spring 6, ensuring that the cantilever spring 6 has a relatively straight form overall. The first end 9 of the first cantilever spring 6 is fixed (e.g. screwed) to the spacer 11 and the spacer 11 is in turn fixed (e.g. screwed) to the flange 4.

It will be appreciated that the mount points of the first ends 9 of both the first cantilever spring 6 and the second cantilever spring 7 are vertically spaced from the safety brake 5 due to the cantilever form of the springs 6, 7. Thus the mount points of the cantilever springs 6, 7 do not interfere with the movement of the safety brake 5 and they do not add to the overall space required for the floating safety brake arrangement. This is particularly advantageous in compact elevators where there is very little width available between the flanges 4 of the upright structure 2.

Figure 2:
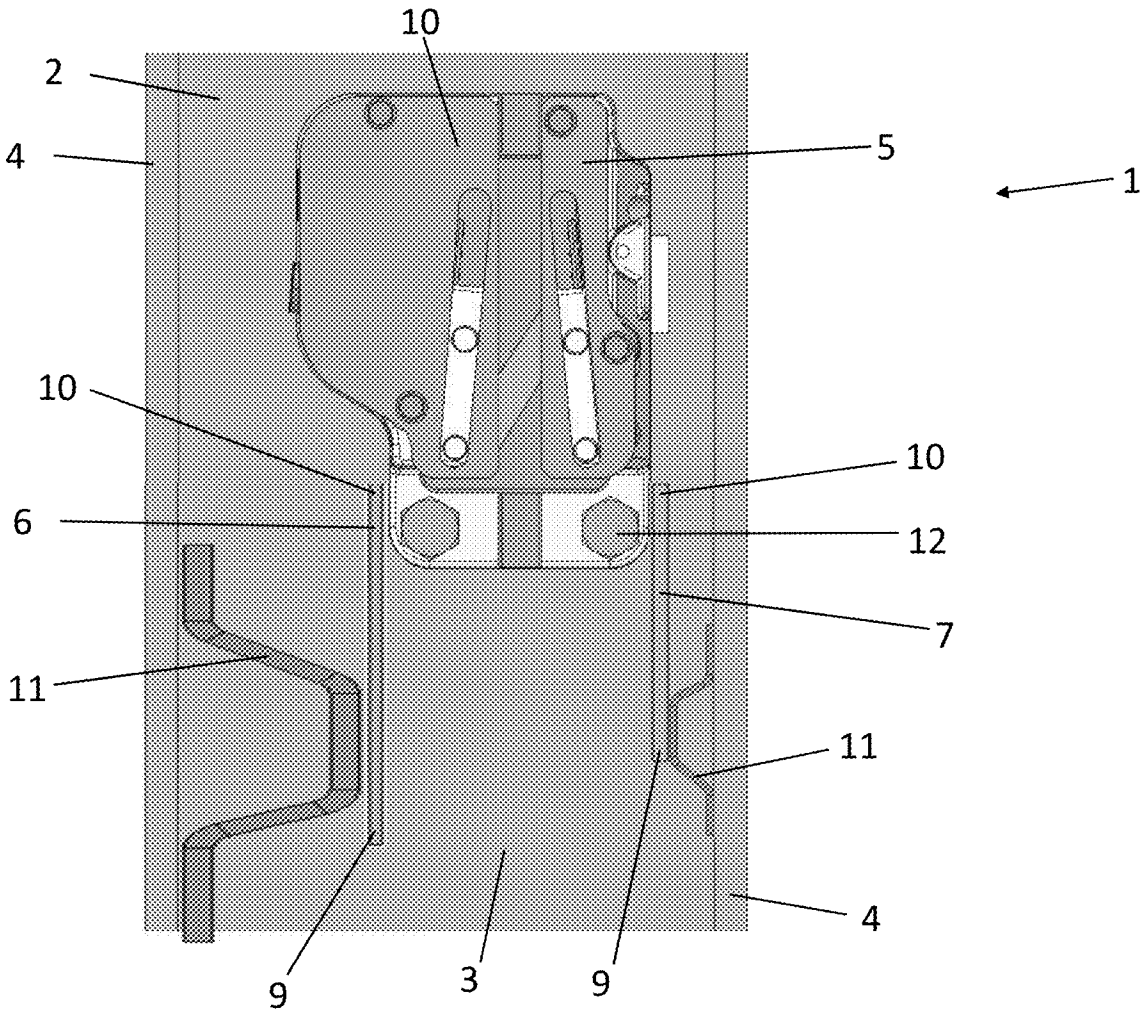
FIG. 2 shows a second example of a safety brake mounting arrangement.

FIG. 2 shows a variation on the arrangement in FIG. 1. The two arrangements are very similar, but in FIG. 2 the two cantilever springs 6, 7 are both perfectly straight, i.e. they are not shaped (e.g. curved) at the second ends 10. Such straight cantilever springs 6, 7 are very easy and inexpensive to manufacture. In this example, due to the lack of shaping at the second ends 10, both cantilever springs 6, 7 are mounted to the flanges 4 of the upright structure 2 via intermediate spacers 11. The spacer 11 for the first cantilever spring 6 is larger than that shown in FIG. 1, while the second cantilever spring 7 is now mounted to a spacer 11 where it was not so mounted in FIG. 1. A further difference between FIGS. 1 and 2 is that in FIG. 1 the contact points of the cantilever springs 6, 7 (which are close to the second ends 10 thereof, i.e. distal from the first ends 9 thereof) act through the centre of mass of the safety brake 5. By contrast, in FIG. 2, the contact points of the cantilever springs 6, 7 act on the safety brake 5 in line with the bolts 12 which mount the safety brake 5, in floating manner, to the web 3 of the upright structure 2. These two contact arrangements can both be useful depending on the particular arrangement. The optimal contact arrangement can be selected according to the particular arrangement to ensure optimal return of the safety brake 5 to its default position after it is released from a braking action.

With reference to FIGS. 3*a-c*, the floating mounting of the safety brake 5 can be seen in more detail.

FIG. 3*a* shows the safety brake arrangement 1 of FIG. 1 with the upright structure 2 removed for clarity. In this figure, the rear of the safety brake 5 can be seen (i.e. the side that faces the web 3 of the upright structure 2). A projection, known as the safety heel projection 13, is formed on the back surface of the safety 5 with a flat upper surface that projects into and engages with a corresponding window (the "safety heel window") 14 formed in the web 3 of the upright structure 2 (and visible in FIG. 3*c*). This connection transmits the braking force of the safety brake 5 to the upright structure 2 and thus to the elevator car or counterweight (not shown). In order to accommodate the lateral movement of the floating safety brake arrangement 1, the safety heel window 14 is formed wider than the safety heel projection 13 so that the safety heel projection 13 can move laterally within the safety heel window 14.

At the lower end of the safety brake 5, the safety brake 5 is held in place against the web 3 of the upright structure 2 in a sliding manner by bolts 12 which pass through bushings 15 and plate 16 and are secured with welded nuts 17. The bushings 15 pass through oblong holes 18 in the web 3 of upright structure 2, the bushings 15 being very slightly longer than the thickness of the upright structure 2 so that the plate 16 does not hold the brake 5 tightly against the upright structure 2, but rather allows relative movement between the two. The oblong holes 18 are longer in the lateral direction than the vertical direction so that they permit lateral movement of the bushings 15 within them as the safety brake 5 moves with respect to the upright structure 2. It will be appreciated that while two oblong holes 18 are shown here, a single elongate slot could be used instead.

FIGS. 4*a-c* show another safety brake mounting arrangement 1 in which a single cantilever spring 8 is used to provide bidirectional biasing of the safety brake 5. The operation and advantages of this arrangement are similar to those discussed above in relation to FIGS. 1 and 2. However, the single cantilever spring 8 of FIGS. 4*a-c* is mounted to the safety brake 5 rather than simply being in contact with the side thereof. As the cantilever spring 8 is mounted to the safety brake 5 (in this example by means of a hole in the second end 10 of the cantilever spring 8 engaging with a projection on the safety brake 5), it will be deflected by movement of the safety brake 5 in either direction. Thus, if the safety brake 5 moves to the left in FIG. 4*a*, the cantilever spring 8 will be deflected to the left, and if the safety brake 5 moves to the right in FIG. 4*a*, the cantilever spring 8 will be deflected to the right. In either case, as the spring is rigidly fixed at its first end 9 to the upright structure 2, the cantilever spring 8 will be deflected from its unbiased position and will provide a return biasing force against the safety brake 5 so as to return the safety brake 5 to its default position. When the safety brake 5 is in its default position, the cantilever spring 8 is also in its neutral, unbiased position so that no biasing force is provided on the safety brake 5 unless it moves away from its default position.

FIG. 4*b* shows the cantilever spring 8 on its own. The first end 9 has a mounting hole 20 for mounting the cantilever spring 8 to the web 3 of the upright structure 2. The first end 9 also has a rectangular shape which is fitted between corresponding projections 21 on the web 3 of the upright structure 2 so as to prevent rotation of the first end 9 of the cantilever spring 8, thus ensuring that movement of the second end 10 bends the cantilever spring 8 rather than simply pivoting it around the mount point. It will be appreciated that two or more such holes 20 could be used to prevent undesired rotation instead of the rectangular shaped first end 9 and corresponding web projections 21. The second end 10 of the cantilever spring 8 also has a mounting hole 22 for engagement with a projection 23 on the safety brake 5. The mounting hole 22 is slightly elongated in the vertical direction to ensure that braking load does not transfer through the cantilever spring 8, thus ensuring long life of the cantilever spring 8.

FIG. 4*c* shows the rear of the upright structure 2 with the upper edge of the safety heel projection 13 engaging with the upper edge of the safety heel window 14 so as to transfer braking force from the safety brake 5 to the upright structure 2. The bushings 15 are also seen extending through the oblong holes 18 with the ability to move laterally therein (the plate 16 is omitted for clarity).

While the present disclosure has been described with reference to certain exemplary embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiments disclosed, but that the present disclosure will include all embodiments falling within the scope of the claims.

What is claimed is:

1. An elevator car or counterweight, comprising a frame, the frame comprising an upright structure in which a safety brake is mounted so as to allow for lateral movement of the safety brake relative to the upright structure;

a first vertically or obliquely extending cantilever spring;

a second vertically or obliquely extending cantilever spring separate from the first cantilever spring;

wherein a first end of the first cantilever spring is mounted to the upright structure and a first end of the second cantilever spring is mounted to the upright structure; and wherein the first cantilever spring is arranged such that a point remote from the first end provides a biasing force to the safety brake when the safety brake moves away from a default position;

wherein a second end of the first cantilever spring is mounted to the safety brake with freedom to move vertically relative to the safety brake.

2. An elevator car or counterweight as claimed in claim 1, wherein the first cantilever spring and the second cantilever spring are arranged to provide a biasing force to the safety brake when the safety brake moves away from the default position in either lateral direction.

3. An elevator car or counterweight as claimed in claim 1, wherein the second cantilever spring is arranged such that a point remote from the first end provides a biasing force to the safety brake when the safety brake moves away from its default position; and wherein the biasing force provided by the first cantilever spring is in the opposite direction to the force provided by the second cantilever spring.

4. An elevator car or counterweight as claimed in claim 1, wherein the upright structure is substantially U-shaped, such that it comprises a web and two flanges.

5. An elevator car or counterweight as claimed in claim 1, wherein the first cantilever spring is arranged to exert its biasing force on the safety brake through a centre of mass of the safety brake.

6. An elevator car or counterweight, comprising a frame, the frame comprising an upright structure in which a safety brake is mounted so as to allow for lateral movement of the safety brake relative to the upright structure;

a first vertically or obliquely extending cantilever spring;

a second vertically or obliquely extending cantilever spring separate from the first vertically extending cantilever spring;

wherein a first end of the first cantilever spring is mounted to the upright structure and a first end of the second cantilever spring is mounted to the upright structure; and wherein the first cantilever spring is arranged such that a point remote from the first end provides a biasing force to the safety brake when the safety brake moves away from a default position;

wherein a first end of the second cantilever spring is mounted to the upright structure; and wherein the second cantilever spring is arranged such that a point remote from the first end provides a biasing force to the safety brake when the safety brake moves away from its default position; and wherein the biasing force provided by the first cantilever spring is in the opposite direction to the force provided by the second cantilever spring;

wherein:

the upright structure is substantially U-shaped, such that it comprises a web and two flanges;

wherein the first end of the first cantilever spring is mounted to one flange (4) of the U-shaped upright structure; and wherein the first end of the second cantilever spring is mounted to the other flange of the U-shaped upright structure.

7. An elevator car or counterweight as claimed in claim 6, wherein the first end of the first and/or second cantilever spring is mounted to its respective flange of the U-shaped upright structure via an intermediate spacer that positions the second end of the respective cantilever spring in unbiased contact with the safety brake when the safety brake is in its default position.

8. An elevator car or counterweight as claimed in claim 7, wherein the first and/or second cantilever spring is substantially straight.

9. An elevator car or counterweight as claimed in claim 6, wherein the second end of the first and/or second cantilever spring is shaped so as to position a biasing surface of the respective spring in unbiased contact with the safety brake when the safety brake is in its default position.

10. An elevator car or counterweight as claimed in claim 9, wherein the second end of the first and/or second cantilever spring is curved so as to make a tangential contact with the safety brake.

11. An elevator car or counterweight as claimed in claim 1, wherein the or each cantilever spring is arranged to exert its biasing force on the safety brake at a point laterally in line with a mounting point of the safety brake to the upright structure.

* * * * *